United States Patent [19]

Murphy

[11] Patent Number: 4,671,423

[45] Date of Patent: Jun. 9, 1987

[54] CONTAINER AND LID MEANS WHICH RESIST REMOVAL AFTER EMPLACEMENT

[75] Inventor: Joseph E. Murphy, Basking Ridge, N.J.

[73] Assignee: Gilbert Plastics, Inc., New Brunswick, N.J.

[21] Appl. No.: 849,826

[22] Filed: Apr. 9, 1986

[51] Int. Cl.[4] ..... B65D 43/06

[52] U.S. Cl. ..... 220/354; 220/355

[58] Field of Search ..... 220/354, 355, 356, 276, 220/306, 307

[56] References Cited

U.S. PATENT DOCUMENTS 4,190,175 2/1980 Allen ..... 220/276

4,296,871 10/1981 Andersson ..... 220/354

*Primary Examiner*—George T. Hall

*Attorney, Agent, or Firm*—Arthur L. Plevy

[57] ABSTRACT

This invention discloses a container apparatus wherein said container apparatus includes a receptacle portion having an opened top and a closed bottom. The container apparatus further comprises a lid adapted to be inserted over the opened top in combination with an apparatus for assuring that when said lid is enplaced upon said receptacle to cover the opened top, the lid cannot be easily removed. The container apparatus comprises a peripheral flange located about the receptacle portion near said opened top. The lid includes a corresponding depending flange which is substantially surrounded by the peripheral flange when said lid is enplaced upon the receptacle portion.

15 Claims, 6 Drawing Figures

CONTAINER AND LID MEANS WHICH RESIST REMOVAL AFTER EMPLACEMENT

FIELD OF INVENTION

This application relates to storage vessels. More specifically, this invention relates to a container having a lid which resists removal after emplacement of the same on the receptacle portion of the container.

BACKGROUND OF THE INVENTION

Among the conveniences afforded by our society are automatic toilet bowl cleaners. These cleaners are purchased in containers, which are placed in the water reservoir of toilets and automatically and continuously clean the toilet by dispensing an amount of cleansing chemical into the water within the toilet bowl reservoir. The cleanser is dispensed from a container which is placed at the bottom of the tank or reservoir. Oftentimes, the container is weighted with rocks so that it will stay submerged. The cleansing chemicals dispensed, often strong acids such as hypochlorite, are brought into contact with the reservoir water by water turbulence created during each flush. The turbulence forces the reservoir water into the container by way of an opening in the lid of the container. The opening is of a size such that only a limited amount of cleansing chemical is released from the container per flush.

Manufacturers of toilet bowl cleaners have faced a problem of consumers failing to read instructions printed on the toilet bowl cleaner containers. It is somewhat commonplace for consumers to improperly use the automatic toilet bowl cleaners by removing the lid of the containers and dumping the contents of the containers into the toilet bowl reservoir. The resultant problems of this improper use are threefold. First, the strong acids may come into contact with the consumer causing irritation, burns or poisoning. Second, causing such a large dose of acid to enter the toilet bowl can result in deterioration of the toilet bowl mechanisms as well as possible damage to septic systems and waste water treatment facilities. Third, rocks or other ballast end up moving freely in the reservoir and pose a risk of clogging the toilet system or otherwise causing improper functioning of the toilet bowl mechanism.

Manufacturers of automatic toilet bowl cleaners have placed instructions on the container stressing the importance of not removing the lid of said containers. The manufacturers have printed these instructions in bold print, different colors, succinct language and used exclamation points. Despite these attempts, they have been unable to thwart consumers from improperly using the cleaners. Applicant's invention solves the problem of improper use of the cleaners through the development of a container apparatus comprising a receptacle member and a lid member which lid member cannot be easily removed from the receptacle member once enplaced thereon.

In addition to its use for automatic toilet bowl cleaner containers, the instant invention can be used in any situation in which a nonconventionally removable lid is desired. Specifically, a container having such a lid is particularly appropriate for containers which need to be child resistant. The lid from moving applicant's container is extremely difficult to remove by conventional techniques. Removal requires considerable strength and agility not likely to be possessed by young children. Therefore, this container also has uses for storage of any type of harsh chemical commonly found in the home for which child resistance is a concern.

SUMMARY OF THE INVENTION

This invention discloses a container apparatus wherein said container apparatus includes a receptacle portion having an opened top and a closed bottom. The container apparatus further comprises a lid adapted to be inserted over the opened top in combination with an apparatus for assuring that when said lid is enplaced upon said receptacle to cover the opened top, the lid cannot be easily removed. The container apparatus comprises a peripheral flange located about the receptacle portion near said opened top. The lid includes a corresponding depending flange which is suitably surrounded by the peripheral flange when said lid is enplaced upon the receptacle portion.

DETAILED DESCRIPTION OF THE DRAWINGS

Figure 1:
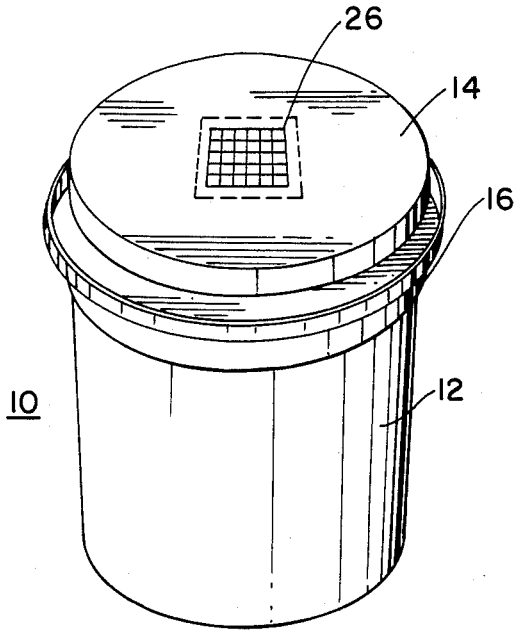
FIG. 1 shows a perspective view of the container apparatus.
Figure 5:
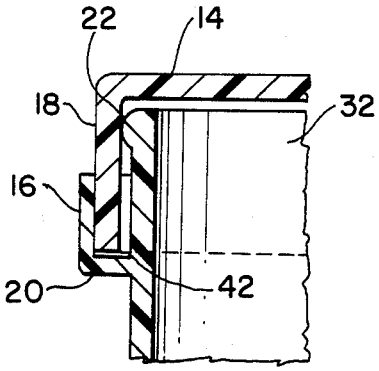
FIG. 5 shows a partial cross sectional view of the lid member in place on the receptacle member.

Referring to FIG. 1, there is shown a container apparatus 10 according to this invention. The container apparatus 10 appears relatively conventional in configuration and includes a receptacle portion 12, with a lid 14. The receptacle portion 12 is best seem in FIG. 3. The receptacle portion is a frusto-conical receptacle having an opened top 32 and a closed bottom 34, with tapered side walls. It is understood that any suitable configuration can be employed for the receptacle portion. Essentially, the container is normally closed by means of a conventional lid 14. In any event, the receptacle portion 12 of the container includes an upstanding peripheral flange 16 which extends about the periphery near the opened top end of the receptacle 12. The peripheral flange 16 depends upwardly and forms a channel 42 as seen in FIG. 5 with the upstanding flange directed towards the open top 32 of the receptacle portion 12.

The lid 14 being relatively conventional has a corresponding depending flange portion to allow the lid to be conventionally inserted over the opened top of the receptacle portion 12. When the lid 14 is in place, its corresponding depending flange 18 is positioned in the channel 42 of the peripheral flange 16 The upstanding flange 16 surrounds and covers the depending flange 18 of the lid 14. In this manner a consumer cannot access or remove the lid 14 by conventional means. The consumer will experience great difficulty in attempting to lift the lid from the receptaole portion due to the fact that the flange 18 associated with the lid is positioned in the channel 42.

Figure 2:
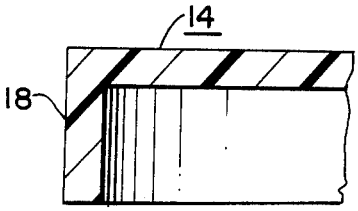
FIG. 2 shows a cross section of the lid member of the container.

In this manner and based on the closeness of the fit, the consumer will not be able to utilize his fingers or his fingernails to access the bottom of the lid in order to pry the lid from the top of the receptacle portion 12. Hence once the lid is in place upon the receptacle portion 12 to cover the opened top, the consumer will experience great difficulty in attempting to remove the lid from the receptacle portion. As shown in FIG. 2, the lid 14 is a conventional lid having a depending flange 18.

Figure 3:
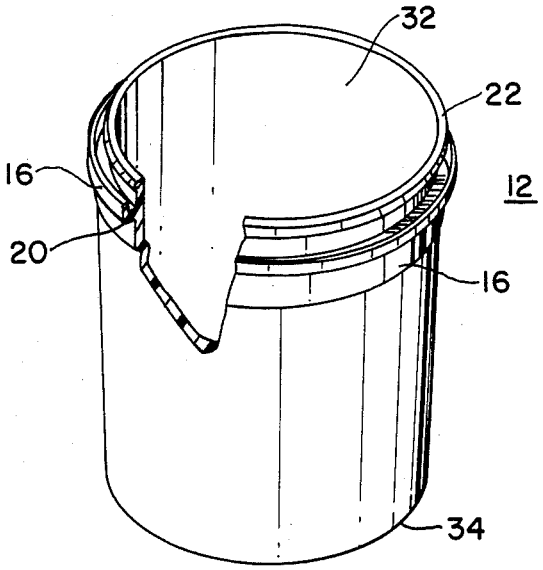
FIG. 3 shows a partial cross sectional view of the receptacle member of the container.

FIG. 3 shows a partial cross-section of the receptacle portion of the container apparatus. As seen from FIG. 3, the receptacle portion 12 has the peripheral flange 16 extending near the opened top and preferably close enough to the top so that the depending flange portion 18 of the lid is suitably surrounded by the external wall of the flange 16. In this manner, as indicated above, the consumer will not have access to the bottom portion of the flange 18 which is inserted into the channel 42 associated with the peripheral flange 16.

Figure 4:
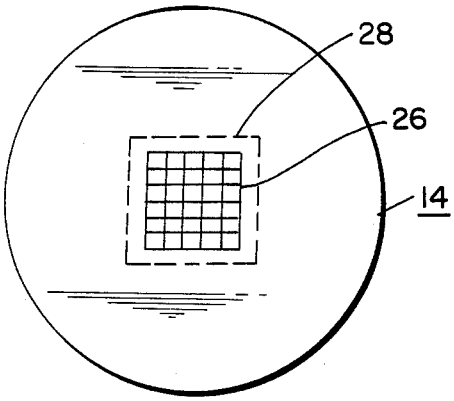
FIG. 4 shows an top plan view of the lid member.

Also shown in FIG. 1 is a top area 26 associated with the lid 14. The area 26 is normally associated with containers as containing typical automatic toilet cleaner preparations. As seen in FIG. 4, the area 26 is surrounded by a perforated section 28 formed on the top surface of the lid 14. The manufacturer instructs the consumer to remove the perforated section of the lid so that the entire container, including the lid, be placed within the toilet bowl in the case of a toilet bowl cleaner. The top portion of the lid is shown in FIG. 4 in greater detail and there is shown the perforated area 28 which surrounds a target area 26 which again is utilized to further inform the consumer that this is the section of the lid which is to be removed. Of course, any means to expedite removal of the target area 26 is acceptable. Thus, if a consumer attempts to remove the lid before reading the direction on the top surface of the lid, he will experience great difficulty. As one can ascertain, the depending flange 18 of the lid 14 is actually captured by the peripheral flange 16 and its associated channel 42 which may be integrally formed with the receptacle portion of the container 12.

Shown in FIG. 5 is the fact that the top portion of the receptacle may include a projecting lip 22. The lip 22, which preferably has an undercut, acts as a sealant and will actually serve to further push the depending flange 18 of the lid 14 towards the left wall of the peripheral flange 16 as evidenced by the partial cross-section of FIG. 5. Hence the lip 22 will further serve to firmly secure the lid to the receptacle portion while the peripheral flange 16 will prevent access by the consumer to the bottom portion of the lid. Thus, the consumer will not be able to remove the lid in a conventional manner and will generally experience great difficulty in attempting to remove the lid in any manner. It is, of course, indicated and shown that the peripheral flange 16 associated with the receptacle portion 12 may be integrally formed with the receptacle portion.

In any event, the peripheral flange 16 may also be secured about an annular ring 20, and hence the unit may be fabricated in two parts. This, of course, is an alternate way of producing the product, though the integral forming of the peripheral flange 16 is a desired embodiment.

The container apparatus may be comprised of any number of materials including various polymers such as plastic and the like. The material selected may vary with regard to the contents or chemicals to be stored in the container. Among the properties which can be selected for the materials are plastics or other materials which are resistant to acids such as hypochlorous acids, salts of acids such as calcium hypochlorite, strong bases such as sodium or potassium hydroxide, or various other materials.

As seen from the above, the particular receptacle portion 12 is shown as being frusto-conical in shape having an opened top 32 and a closed bottom end 34. Of course, any other shape may be utilized, and this invention can be employed with the receptacle portions of the containers of various shapes and configurations.

It is further understood that the flange as shown in FIG. 5 is preferably a right angle flange, but it is understood that the flange can be tapered or otherwise suitably shaped. In this manner the flange may have a taper on the inner wall which tapers from a relatively wide area to a smaller area as shown in FIG. 6.

Figure 6:
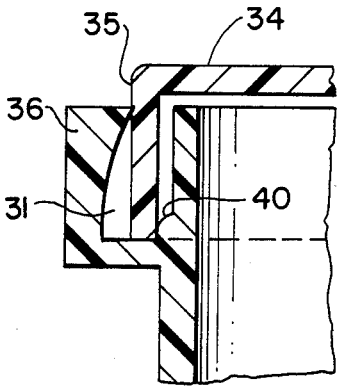
FIG. 6 shows a partial cross sectional view of an alternate embodiment of a receptacle and lid member.

As one can see from FIG. 6, there is a lip 40 which instead of being located at the top portion of the receptacle portion 12 may be located at the bottom portion of the channel 31 formed by the flange 36. Essentially, as one can ascertain, the lip 40 would further tend to push the bottom of the depending flange 38 associated with the lid 34 towards the outer wall, thus making it more difficult to gain access to the bottom of the lid.

As can further be seen from FIG. 6, the tapered front wall of the flange also serves to act as a further deterrent for a consumer as, due to the narrow insert space, the consumer will have more difficulty in attempting to grasp and remove the lid from the receptacle portion.

In view of the above, it is understood that there are many different types of flanges which can be employed for the peripheral flange as flange 16 on the receptacle portion of the container. It is thus seen that a main objective of the present invention is to provide a peripheral flange which essentially serves to surround a significant portion of the depending flange associated with the lid and thereby to prevent a consumer from accessing and removing the lid by prying or lifting the lid in a conventional manner. It is, of course, understood that the apparatus can be implemented in many different ways without departing from the objectives of this invention.

I claim:

1. A container apparatus wherein said container includes a receptacle portion having an opened top and a closed bottom, and a lid adapted to be inserted over said opened top in combination with an apparatus for assuring that when said lid is emplaced upon said receptacle said lid cannot be conventionally removed, comprising an upwardly depending peripheral flange located about said receptacle near said opened top; said lid having a corresponding depending flange which is totally surrounded by said peripheral flange when said lid is emplaced uponsaid receptacle portion, with the upstanding inner wall of said peripheral flange having a taper whereby said wall is thicker at the top than at the bottom to thereby provide a narrow insert space for said depending flange of said lid.

2. The container of claim 1 wherein said peripheral flange rests on an annular ring about said receptacle.

3. The container of claim 1 wherein said opened top is surrounded by a lip.

4. The container of claim 3 wherein said lip has an undercut.

5. The container of claim 3 wherein said lip is narrower than an annular ring about said receptacle upon which rests said peripheral flange.

6. The container of claim 1 wherein said lid comprises a selectively removable area.

7. The container of claim 6 wherein said selective removable area is perforated.

8. The container of claim 1 wherein said receptacle is comprised of a plastic material.

9. The container of claim 8 wherein said plastic material is resistant to acid.

10. The container of claim 8 wherein said plastic material is resistant to hypochlorous acid.

11. The container of claim 8 wherein said plastic material is resistant to calcium hypochlorite.

12. The container of claim 1 wherein said container is resistant to base.

13. The container of claim 1 wherein said container can hold radioactive material.

14. A container apparatus wherein said container includes a receptacle portion having an opened top and a closed bottom and a lid adapted to be inserted over said opened top wherein said lid cannot be conventionally removed, comprising an upstanding flange directed about the periphery of said receptacle near the opened top with said flange forming a lid accommodating channel about said opened top; said lid having a complimentary depending flange resting with the channel of said upstanding flange when said lid is emplaced upon said receptacle portion, with the unstanding inner wall of said upstanding flange being tapered and being thicker at the top than at the bottom to thereby provide a narrow insert space for said depending flange of said lid.

15. A container apparatus according to 14 wherein said flange is a right angle flange.

* * * * *